US012139831B2

(12) United States Patent
Finnis et al.

(10) Patent No.: US 12,139,831 B2
(45) Date of Patent: Nov. 12, 2024

(54) BAST FIBER, FABRICS MADE THEREWITH, AND RELATED METHOD OF MANUFACTURE

(71) Applicant: BAST FIBRE TECHNOLOGIES INC., Victoria (CA)

(72) Inventors: Jason David Finnis, Victoria (CA); Wade Edsel Chute, St. Albert (CA)

(73) Assignee: BAST FIBRE TECHNOLOGIES INC., Victoria (CA)

( * ) Notice: Subject to any disclaimer, the term of this patent is extended or adjusted under 35 U.S.C. 154(b) by 176 days.

(21) Appl. No.: 17/763,244

(22) PCT Filed: Sep. 24, 2020

(86) PCT No.: PCT/IB2020/058964

§ 371 (c)(1),
(2) Date: Mar. 24, 2022

(87) PCT Pub. No.: WO2021/059208

PCT Pub. Date: Apr. 1, 2021

(65) Prior Publication Data

US 2022/0341063 A1 Oct. 27, 2022

Related U.S. Application Data

(60) Provisional application No. 62/905,940, filed on Sep. 25, 2019.

(51) Int. Cl.
*D04H 1/425* (2012.01)
*D01C 1/02* (2006.01)
(Continued)

(52) U.S. Cl.
CPC ..... *D04H 1/425* (2013.01); *D01C 1/02* (2013.01); *D04H 1/4266* (2013.01);
(Continued)

(58) Field of Classification Search
CPC ..... D04H 1/425; D04H 1/4266; D04H 1/43835; D04H 1/72; D04H 1/43918; D01C 1/02
See application file for complete search history.

(56) References Cited

U.S. PATENT DOCUMENTS 2,121,378 A * 6/1938 Wilkinson ..... D01B 1/22 19/24
3,032,829 A * 5/1962 Mahoney ..... A24D 3/0204 28/282

(Continued)

FOREIGN PATENT DOCUMENTS

CA 2829007 9/2012
CA 2801369 1/2017

(Continued)

OTHER PUBLICATIONS

Jonn Foulk and David McAlister, Favimat Analysis of Single Cotton Fibers, reprinted from the Proceedings of the Beltwide Cotton Conference, vol. 2:1261-1267 (2001).*

(Continued)

*Primary Examiner* — Shaun R Hurley
(74) *Attorney, Agent, or Firm* — Womble Bond Dickinson (US) LLP

(57) ABSTRACT

The invention relates to methods for providing crimped bast fibers which may include providing an input of bast fibers, adjusting the moisture content of the bast fibers to be in the range of about 10% to about 40% by weight to form a fiber mat, and contacting the fiber mat with a pair of heated crimping rolls to provide crimped bast fibers having a crimp of about 1 to about 10 crimps per centimeter. The invention further provides for a nonwoven fabric comprising at least 5% of the crimped bast fibers. The crimping of the bast fibers in these nonwoven fabrics is beneficial to forming a drylaid, airlaid or wetlaid nonwoven fabric that has desirable prop- (Continued)

erties related to performance in a variety of nonwoven product applications.

18 Claims, 7 Drawing Sheets

(51) Int. Cl.
*D04H 1/4266* (2012.01)
*D04H 1/4382* (2012.01)
*D04H 1/72* (2012.01)
*D02G 1/02* (2006.01)

(52) U.S. Cl.
CPC ..... *D04H 1/43835* (2020.05); *D04H 1/72* (2013.01); *D02G 1/0293* (2013.01); *D10B 2201/01* (2013.01)

(56) References Cited

U.S. PATENT DOCUMENTS

| | | | | |
|---|---|---|---|---|
| 3,345,718 | A * | 10/1967 | Hollihan | D02G 1/14 28/258 |
| 3,354,511 | A * | 11/1967 | Ross | D02G 1/12 28/258 |
| 3,451,885 | A * | 6/1969 | Klein | B32B 5/22 28/106 |
| 4,109,356 | A | 8/1978 | Mazzone | |
| 5,319,831 | A | 6/1994 | Takehara | |
| 5,393,304 | A | 2/1995 | Vuillaume et al. | |
| 5,486,167 | A * | 1/1996 | Dragoo | A61F 13/74 604/358 |
| 5,497,928 | A * | 3/1996 | Burns | B65H 51/10 226/188 |
| 5,970,582 | A * | 10/1999 | Stover | D01B 1/40 19/24 |
| 6,079,087 | A | 6/2000 | Cansler | |
| 6,767,498 | B1 * | 7/2004 | Talley, Jr. | D01F 8/06 264/210.8 |
| 6,820,406 | B2 | 11/2004 | Khavkine et al. | |
| 8,591,701 | B2 | 11/2013 | Sung et al. | |
| 8,650,717 | B2 * | 2/2014 | Hao | D01G 19/00 19/0.35 |
| 8,969,441 | B2 | 3/2015 | Yano et al. | |
| 9,187,848 | B2 | 11/2015 | Graveson | |
| 9,926,654 | B2 * | 3/2018 | Baer | B32B 38/0012 |
| 9,926,655 | B2 | 3/2018 | Baer et al. | |
| 9,932,461 | B2 | 4/2018 | Banzashi et al. | |
| 9,949,609 | B2 | 4/2018 | Baer et al. | |
| 10,519,579 | B2 | 12/2019 | Baer et al. | |
| 2003/0157323 | A1 * | 8/2003 | Khavkine | D02G 3/04 428/373 |
| 2004/0058600 | A1 | 3/2004 | Bunyard et al. | |
| 2010/0136073 | A1 | 6/2010 | Preuss et al. | |
| 2010/0147472 | A1 | 6/2010 | Sung et al. | |
| 2011/0220311 | A1 | 9/2011 | Champion et al. | |
| 2014/0066872 | A1 | 3/2014 | Baer et al. | |
| 2014/0259484 | A1 * | 9/2014 | Baer | A61Q 19/00 15/104.93 |
| 2015/0337485 | A1 | 11/2015 | Lee | |
| 2015/0337486 | A1 | 11/2015 | Lee et al. | |
| 2015/0337496 | A1 | 11/2015 | Lee | |
| 2016/0201239 | A1 | 7/2016 | Baer et al. | |
| 2017/0191197 | A1 * | 7/2017 | Talwar | D04H 1/5412 |
| 2017/0233909 | A1 | 8/2017 | Wright et al. | |
| 2017/0254023 | A1 | 9/2017 | Sumnicht et al. | |
| 2019/0257029 | A1 | 8/2019 | Kiihn et al. | |
| 2019/0376011 | A1 | 12/2019 | Cavadeas et al. | |
| 2021/0002800 | A1 * | 1/2021 | Finnis | D04H 1/425 |

FOREIGN PATENT DOCUMENTS

| | | |
|---|---|---|
| CA | 2880567 | 6/2019 |
| CA | 3094592 | 9/2019 |
| CN | 1907185 | 2/2007 |
| CN | 1908274 | 2/2007 |
| CN | 100415955 C | 9/2008 |
| CN | 101381929 | 3/2009 |
| CN | 103114338 | 5/2013 |
| DE | 102009043428 | 4/2011 |
| EP | 1350456 | 10/2003 |
| EP | 1798319 | 6/2007 |
| EP | 2743388 | 6/2014 |
| EP | 2963167 | 1/2016 |
| JP | 2013036140 | 2/2013 |
| JP | 2018080410 | 5/2018 |
| KR | 20130129321 | 11/2013 |
| WO | WO 99/37834 | 7/1999 |
| WO | WO 99/57353 | 11/1999 |
| WO | WO2018/124832 | 7/2018 |
| WO | WO2018/160584 | 9/2018 |
| WO | WO 2018160588 | 9/2018 |
| WO | WO2019/180681 | 9/2019 |

OTHER PUBLICATIONS

Alix et al., Pressure impact of autoclave treatment on water sorption and pectin composition of flax cellulosic-fibres, Carbohydrate Polymers (2014), 102, 21-29, CODEN: CAPOD8; ISSN: 0144-8617.

Calamari et al., Structure and properties ofkenaf fiber bundles, Book of Abstracts, 211th ACS National Meeting, New Orleans, LA, Mar. 24-28, 1996, Cell-105 Publisher: American Chemical Society, Washington, D. C.

Colinart et al., Radiative and Hygrothermal Properties of Flax/Viscose Spuulaced Nonwovens, *Journal of Industrial Textiles*, 2016, vol. 46, pp. 1-15.

Das et al. Composite Nonwovens, *Textile Progress*, vol. 44, pp. 1-84 I, Published online: Apr. 27, 2012.

De Guzman et al., Abaca, kenaf and pineapple fibers for nonwovenfabrics, NSTA Technology Journal (1982), 7(1), 77-87, CODEN: NTJODS; ISSN: 0115-9275.

Freivalde, et al., Content of Hemp Fibres and Properties ofNonwovens. Material Science. Textile and Clothing Technology. vol. 7, 2012, pp. 84-89. ISSN 1691-3132. e-ISSN 2255-8888.

Ghorpade et al., Microbial retting of banana pseudostem for extracting textile grade fibers and its applications, Man-Made Textiles in India (2013), (5), 149-153, CODEN: MMTIBW; ISSN: 0377-7537.

Kozlowski, Handbook of Natural Fibres: Types, Properties and Factors Affecting Breeding and Cultivation, Elsevier, Oct. 19, 2012, pp. 72-73. https://books.google.co.uk/books?id=0o1wAgAAQBAJ&printsec=frontcover&source=gbs_atb#v=onepage&q&f=false.

Li et al., Surface modification of kenaf fiber and application of it on polypropylene composite, *Gongcheng Suliao Yingyong* (2014), 42(2), 6-10, CODEN: GSYOAG; ISSN: 1001-3539.

Meijer et al., The Pectin Content As A Measure Of The Retting And Rettability Of Flax, *Industrial Crops and Products*, vol. 4, Issue 4, Dec. 1995, pp. 273-284.

Miao et al., Biodegradable mulch fabric by surface fibrillation and entanglement of plant fibers, *Textile Research Journal* (2013), 83(18), 1906-1917, 12 pp. CODEN: TRJOA9; ISSN: 0040-5175.

Parikh et al., Thermoformable automotive composites containing kenaf and other cellulosic fibers, Textile Research Journal (2002), 72(8), 668-672, CODEN: TRJOA9; ISSN: 0040-5175.

Parikh et al., Improved chemical retting of kenaf fibers, Textile Research Journal (2002), 72(7), 618-624, CODEN: TRJOA9; ISSN: 0040-5175.

Ramaswamy et al., Effect of bacterial and chemical retting on kenaf fiber quality, Textile Research Journal (1994), 64(5), 305-8, CODEN: TRJOA9; ISSN: 0040-5175.

Sun et al., Production practice of wet-laid nonwovens of flax tow, *Fang=hi Daobao* (2009), (5), 93-94 CODEN: FDAABB; ISSN: 1003-3025; Chinese.

Yu et al., Treatment and characterization of kenaf for nonwoven and woven applications, International Nonwovens Journal [online com-

(56) References Cited

OTHER PUBLICATIONS puter file] (2000), 9(4), 29-33, CODEN: INOJEA; ISSN: 1527-2494
http://www.inda.org/subscrip/inj00_4/winter00.pdf.

* cited by examiner

BAST FIBER, FABRICS MADE THEREWITH, AND RELATED METHOD OF MANUFACTURE

CROSS-REFERENCE TO RELATED APPLICATIONS

The present application is a U.S. National Stage of International Patent Application PCT/IB2020/058964 filed Sep. 24, 2020, and claims priority to and the benefit of U.S. Provisional Patent Application No. 62/905,940, filed Sep. 25, 2019. The disclosures of each of the applications noted above are incorporated herein by reference in their entirety.

FIELD OF THE INVENTION

The present invention relates to naturally occurring cellulosic fibers, nonwoven fabrics containing at least a portion of naturally occurring cellulosic fibers, and methods of manufacturing such nonwoven fabrics. More specifically, the present invention relates to nonwoven fabrics containing bast fibers.

BACKGROUND

Cellulosic fibers, sourced from plants, have long been used to produce both traditional textile woven and knit fabrics, as well as nonwoven textiles. In general, naturally occurring cellulosic fibers are of three basic types: seed fibers such as cotton and kapok, leaf fibers such as abaca and sisal, and bast fibers such as flax, hemp, jute and kenaf. The seed fibers are known for softness, and that in combination with the length of cotton fibers made them highly desired for the manufacture of yarns and fabrics, particularly for clothing. Bast and leaf fibers, being generally coarser and stiff have historically tended to be used more for cordage, netting and matting.

Along with animal hair and fibers, and silk, the naturally occurring cellulosics were the source of fibers for textile processing for many centuries. And through those centuries textile and fiber development has been motivated by a desire to modify these materials to provide new or augmented properties or to improve processing efficiency. While much of this relied upon mechanical means to improve fiber processing or husbandry to improve fiber properties, chemistry was also used to improve fiber aesthetics, such as through dyeing, and softness, such as through scouring or retting to remove certain chemicals associated with the surface of natural fibers.

There remained both a need for, and scientific interest in, fibers that had properties and economics that were beyond what had been achievable with natural fibers. The invention of rayon in 1846 marked the beginning of synthetic fiber development. Using nature as an inventive prompt, rayon, a regenerated cellulose, was developed to be a more cost-effective alternative to silk fibers. In the 1900's, the development of synthetic fibers based on petrochemicals led to such industry-changing inventions as polyamide, polyester, polyaramid, and polyolefin fibers, to name some major examples. The list of synthetic fibers with properties that are specific to their polymer chemistry has supported the expansion of fiber-based materials in common use across the full spectrum of human industry. With this expanded use came concomitant improvements in textile-type products that have been in use for centuries as well as new products spawned by $20^{th}$ and $21^{st}$ Century technology demands.

Traditional textile fabric formation technology has long relied upon carding as a means to separate, individualize, and align fibers as part of the yarn-making process that is core to weaving and knitting such fabrics. Indeed, the essential aspects of carding, repeated combing of a fiber bundle, remain the same, while industrialized improvements have led to increased processing speeds with greater final product uniformity and improved cost of manufacturing.

High speed carding of fibers supported the expansion of nonwoven textile technology and the development of affordable single-use fiber-based products, such as disposable surgical gowns and infant diapers and filters. While other nonwoven technologies that allow the production of nonwoven fabrics directly from petroleum sourced polymer resins, such as spunbond and meltblowing, have gained a strong position in the nonwoven textile industry and the commercial products from that industry, there remains a need and desire for products produced via the carding process.

Among the advantages of carding versus spunbonding for example, is the ability to readily blend two or more types of fibers together for the purpose of producing fabrics with functional benefits that are derived from each fiber type in the blend. For example, strong but hydrophobic polyester fibers might be blended with weaker but hydrophilic rayon fibers to produce a nonwoven fabric that is stronger than an equivalent rayon nonwoven but has the ability to readily absorb fluids.

Nonwoven textile technology in specific has long been valued for the capability to produce fiber-based products with targeted functionalities at favorable price points. The ability to blend selected fibers in the production of certain types of nonwoven manufacturing processes promotes a strong need for and interest in both natural and synthetic fibers to produce nonwoven fabrics with particular performance and aesthetic properties. Further, while synthetic fibers maintain a substantial presence in the textile industry, sustainability and carbon footprint issues that are prevalent topics in many aspects of industry today are also a focus in both the traditional and nonwoven textile industries.

To that end, cellulosic types are the natural fibers that most preferred in nonwoven textile manufacturing. Cotton is the most common of these used in traditional textiles, but cotton fibers are not compatible with the current high speed cards used to produce drylaid nonwoven textiles. Wood pulp is another cellulosic fiber used in nonwovens, but it has seen limited use beyond specialty papers and a specific type of nonwoven technology referred to as conforming, where pulp fibers are blended in a stream of forming fibers spun from a thermoplastic polymer melt to make absorbent products, such as described in U.S. Pat. No. 4,100,324 to Anderson et al., and others assigned to Kimberly-Clark.

Bast fibers are substantially straight as recovered from the plant source. However, most nonwoven processing, particularly drylaid techniques such as carding, require a level of fiber-to-fiber cohesion to support high speed processing with good efficiency and resulting fabric properties. In addition to surface friction, this cohesion relates to a type of three-dimensional (3-D) geometry in the fiber shape, readily described as undulations or waviness along the length of individual fibers. In synthetic fiber manufacturing, the geometric property of crimp, is imposed on the fibers. In nature, genetics and growth conditions induce a type of crimp, represented as convolutions, or "twisted ribbon" in cotton fibers, and a coiled configuration in wool, as examples. Particularly in nonwoven processing, fiber crimp is known to have an impact on production efficiency, and resulting fabric properties such as fabric bulk, bulk stability, and abrasion resistance, to name a few. Additionally, certain nonwoven processing techniques require some minimum fiber length in order to both process at acceptable efficiencies and to provide good functionality to the resulting fabric.

Nonwoven web forming methods for natural and man-made staple fibers include wet forming and dry formation. Wet forming is similar to the paper making process and accommodates natural fibers with a typical length of 6-10 mm long and wood fibers that are 2-4 mm long.

Accordingly, there is a need for a nonwoven fabric which employs natural bast fibers in concentrations up to 100% by weight, having a mean fiber length of greater than 6 mm with improved fiber-to-fiber cohesion to aid processing and fabric properties.

SUMMARY OF THE INVENTION

It is a known feature of bast fibers that the fibers are naturally straight and exhibit poor fiber-to-fiber cohesion due to a lack of natural crimp, resulting in less than optimum processing of those fibers when employed in certain nonwoven fabric forming processes. Those processes rely upon fiber-fiber contact in the formation of the randomized array of fibers form the basic architecture of a nonwoven fabric, and thereby contributing to strength and integrity in the final fabric form. Where fibers are straight and smooth, insufficient surface friction of those fibers can allow excessive loss of fibers as waste during manufacturing. Additionally, straight fibers may dissociate from other fibers in the resulting random array of fibers, thereby resulting in a fabric architecture that has reduced strength and integrity.

In certain embodiments, the present disclosure provides solutions to address the above-noted shortcomings of bast fibers for use in the formation of nonwoven fabrics, by utilizing a method of forming crimped bast fibers, comprising: providing an input of bast fibers; adjusting the moisture content of the bast fibers to be in the range of about 10% to about 40% by weight to form a fiber mat; and contacting the fiber mat with a pair of heated crimping rolls to provide crimped bast fibers having a crimp of about 1 to about 10 crimps per centimeter, the pair of heated crimping rolls comprising a first crimping roll being positioned proximate to the top side of the fiber mat and opposing a second crimping roll positioned proximate to the bottom side of the fiber mat.

In some embodiments the methods disclosed herein may further comprise compressing the fiber mat prior to contact with the heated crimping rolls. In some embodiments, the pair of heated crimping rolls maintain a temperature of between about 100° C. to about 250° C., such as about 120° C. to about 180° C., or about 130° C. to about 170° C. In some embodiments, the pair of heated crimping rolls are configured to apply a force to the fiber mat of about 5 $lb_f$ per linear inch to about 100 $lb_f$ per linear inch. In some embodiments, the contacting step may comprise two or more pairs of heated crimping rolls.

In some embodiments, the crimps in the crimped bast fibers are substantially triangular in shape. In some embodiments, the crimps have a crimp angle in the range of about 30° C. to about 150° C., such as about 60° to about 120°, as measured from the tip of the crimp.

In further embodiments, the disclosed methods may further comprise drying the crimped bast fibers to a moisture content of about 5% to about 20% based on the total weight of the crimped bast fibers following the contacting step. In some embodiments, the disclosed methods may further comprise subjecting the bast fibers to a fiber opener configured to open the fibers and adjust the density of the input of bast fibers prior to adjusting the moisture content. In some embodiments, the disclosed methods may further comprise extracting excess air from the opened bast fibers using an air separator following the fiber opening step and prior to adjusting the moisture content.

In some embodiments, a nonwoven fabric may be prepared which incorporates about 5% to about 100% of natural bast fibers which have been treated to provide a crimp level of at least 1 crimp per cm of fiber length on average, and which may have as many as 10 crimps per cm of fiber length. It is an aspect of the present disclosure that the majority of the crimped bast fibers in the nonwoven fabric so produced and exhibiting a crimp level have a mean length of at least 6 mm.

It is a further aspect of the present disclosure that the bast fibers described, in all forms, have been treated such that the natural pectin, which adheres the individual fibers together in bundles as recovered from the plant source, has been removed in sufficient measure that the bast fibers are individualized as used in the nonwoven fabric forming processes to produce the nonwoven fabric. Removal of pectin from the fibers can be achieved using various conventional techniques, e.g., such as enzymatic or chemical based washing.

It is a feature of the means of imposing said crimp level that a given single fiber of less than 1 cm may have at least 1 crimp along that length, as the mechanical or chemical treatment to impose the crimp is a bulk process rather than an individual fiber treatment. Such crimp is associated with improved processing of these crimped bast fibers through nonwoven fabric forming processes, including drylaid, airlaid and wetlaid, with resulting improved fabric properties in the products of that processing.

In a further embodiment, the bast fiber nonwoven fabric may contain crimped bast fibers from more than one source of natural bast fiber.

It is an embodiment of the present disclosure that some portion of bast fibers in a bast fiber nonwoven fabric of the invention may have a crimp level of less than 1 crimp per centimeter of fiber length.

In some embodiments of the present disclosure, the bast fiber nonwoven fabrics comprise crimped bast fibers at a level of at least 5% to 100% of those bast fibers on weight of the fabric, where the balance of the fabric weight is 95 to 0% of other natural or synthetic fibers, and where those fibers may be a single type of fiber or a blend of two or more fiber types. Certain embodiments of the bast fiber containing nonwoven fabrics of the invention, where the bast fibers have about 1 to about 10 crimps per cm on average, demonstrate improved bulk and bulk stability over similar fabrics produced using substantially straight bast fibers.

In some embodiments of the present disclosure, the bast fiber nonwoven fabric may be produced by methods of forming that include drylaid, or airlaid, or wetlaid processing. It is known in the industry that the terms drylaid, airlaid or wetlaid, which may be rendered as dry-laid, air-laid or wet-laid, are broad in meaning and that each incorporates a variety of equipment, processes and means. The use of drylaid, airlaid, and wetlaid are not limiting and each do not define a single process for means of manufacturing.

It is a further aspect of the instant disclosure that the product of the drylaid, airlaid or wetlaid fabric forming process may be bonded, also sometimes called consolidated or stabilized, by thermal, mechanical, or chemical means to provide some of the final physical and aesthetic properties of the bast fiber nonwoven fabric included herein.

Thermal bonding means include, but are not limited to, thermal point bonding, through air bonding or calendering. Mechanical bonding means include, but are not limited to, needlepunch or hydroentangling. Adhesive bonding means include liquid adhesive applied by means including, but not limited to, dip-and-squeeze, gravure roll, spray and foam, and also include hot-melt applications, and adhesive powders applications.

Bast fibers utilized in this disclosure can be individualized via mechanical or chemical cleaning.

In some embodiments, the bast fibers may optionally be pre-treated with various coatings (e.g., such as salts, polymers, resins, etc.) prior to crimping in order to improve crimp retention.

The present disclosure includes, without limitation, the following embodiments.

Embodiment 1: A crimped plant-based fiber having a crimp of about 1 to about 10 crimps per centimeter.

Embodiment 2: The crimped plant-based fiber of embodiment 1, wherein the plant-based fibers are bast fibers.

Embodiment 3: The crimped plant-based fiber of any of embodiments 1-2, wherein the plant-based fibers are extracted from flax, hemp, jute, ramie, nettle, Spanish broom, kenaf plants, or any combination thereof.

Embodiment 4: The crimped plant-based fiber of any of embodiments 1-3, where said crimped bast fibers have been cleaned to remove naturally occurring pectin.

Embodiment 5: The crimped plant-based fiber of any of embodiments 1-4, wherein the individual crimps have a crimp angle in the range of about 30° to about 150° as measured from the tip of the crimp.

Embodiment 6: A nonwoven fabric comprising a plurality of crimped plant-based fibers according to any one of embodiments 1-5.

Embodiment 7: The nonwoven fabric of embodiment 6, wherein the nonwoven fabric comprises 5-100% by weight of crimped bast fibers.

Embodiment 8: The nonwoven fabric of any of embodiments 6-7, further comprising natural staple fibers, man-made staple fibers, or a combination thereof, the staple fibers being crimped or uncrimped.

Embodiment 9: The nonwoven fabric of any of embodiments 6-8, wherein the individual crimps in the nonwoven fabric are substantially triangular in shape.

Embodiment 10: A method of forming crimped bast fibers, comprising: providing an input of bast fibers; adjusting the moisture content of the bast fibers to be in the range of about 10% to about 40% by weight; forming the bast fibers into a fiber mat; and crimping the fibers in the fiber mat to provide crimped bast fibers having a crimp of about 1 to about 10 crimps per centimeter, such as by contacting the fiber mat with a pair of heated crimping rolls to provide the crimped bast fibers having a crimp of about 1 to about 10 crimps per centimeter, the pair of heated crimping rolls comprising a first crimping roll being positioned proximate to the top side of the fiber mat and opposing a second crimping roll positioned proximate to the bottom side of the fiber mat.

Embodiment 11: The method of embodiment 10, further comprising compressing the fiber mat prior to contact with the heated crimping rolls.

Embodiment 12: The method of any one of embodiments 10-11, wherein the pair of heated crimping rolls maintain a temperature of between about 100° C. to about 250° C.

Embodiment 13: The method of any of embodiments 10-12, wherein the pair of heated crimping rolls are configured to apply a force to the fiber mat of about 5 lbf per linear inch to about 100 lbf per linear inch.

Embodiment 14: The method of any of embodiments 10-13, wherein the contacting step comprises one or more pairs of heated crimping rolls.

Embodiment 15: The method of any of embodiments 10-14, wherein the crimps in the crimped bast fibers are substantially triangular in shape.

Embodiment 16: The method of any of embodiments 10-15, wherein the crimps have a crimp angle in the range of about 30° to about 150° as measured from the tip of the crimp.

Embodiment 17: The method of any of embodiments 10-16, further comprising drying the crimped bast fibers to a moisture content of about 5% to about 20% based on the total weight of the crimped bast fibers following the contacting step.

Embodiment 18: The method of any of embodiments 10-17, further comprising subjecting the bast fibers to a fiber opener configured to open the fibers and adjust the density of the input of bast fibers prior to adjusting the moisture content.

Embodiment 19: The method of any of embodiments 10-18, further comprising extracting excess air from the opened bast fibers using an air separator following the fiber opening step and prior to adjusting the moisture content.

Embodiment 20: The method of any of embodiments 10-19, further comprising forming a nonwoven fabric comprising at least about 5% by weight of the crimped bast fibers.

Embodiment 21: The method of any of embodiments 10-20, wherein forming the nonwoven fabric comprises a drylaid process, an airlaid process, or a wetlaid process.

Embodiment 22: The method of any of embodiments 10-21, wherein the adjusting step comprises subjecting the bast fibers to air drying to achieve the desired moisture content.

Embodiment 23: The method of any one of embodiments 10-22, wherein the adjusting step comprises subjecting the bast fibers to steam conditioning to achieve the desired moisture content.

Embodiment 24: The method of any of embodiments 10-23, wherein the steam conditioning step comprises contacting the fiber mat with saturated steam at atmospheric pressure.

Embodiment 25: The method of any of embodiments 10-24, further comprising adjusting the density of the bast fibers to provide density-controlled fibers prior to adjusting the moisture content.

Embodiment 26: A crimping apparatus comprising at least one set of crimping rolls comprising a first crimping roll and a second crimping roll, the first and second crimping rolls being positioned proximal to one another and adapted to compress a fiber mat therebetween, each crimping roll having a plurality of grooves in an outer surface thereof, the plurality of grooves having an angle of about 30 to about 150 degrees.

Embodiment 27: The crimping apparatus of embodiment 26, further comprising at least one pneumatic cylinder positioned to apply a compression force to the area between the first and second crimping rolls.

Embodiment 28: The crimping apparatus of any of embodiments 26-27, wherein the compression force is at least 5 lbf per linear inch.

Embodiment 29: The crimping apparatus of any of embodiments 26-28, wherein at least one of the first and second crimping rolls is heated.

Embodiment 30: The crimping apparatus of any of embodiments 26-29, wherein at least one of the first and second crimping rolls is heated to a temperature of about 100° C. to about 250° C.

These and other features, aspects, and advantages of the disclosure will be apparent from the following detailed description together with the accompanying drawings, which are briefly described below. The invention includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed invention, in any of its various aspects and embodiments, should be viewed as intended to be combinable unless the context clearly dictates otherwise. Other aspects and advantages of the present invention will become apparent from the following.

BRIEF DESCRIPTION OF THE DRAWINGS

In order to provide an understanding of embodiments of the invention, reference is made to the appended drawings, in which reference numerals refer to components of exemplary embodiments of the invention. The drawings are exemplary only and should not be construed as limiting the invention. The disclosure described herein is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DESCRIPTION OF THE INVENTION

Figure 1:
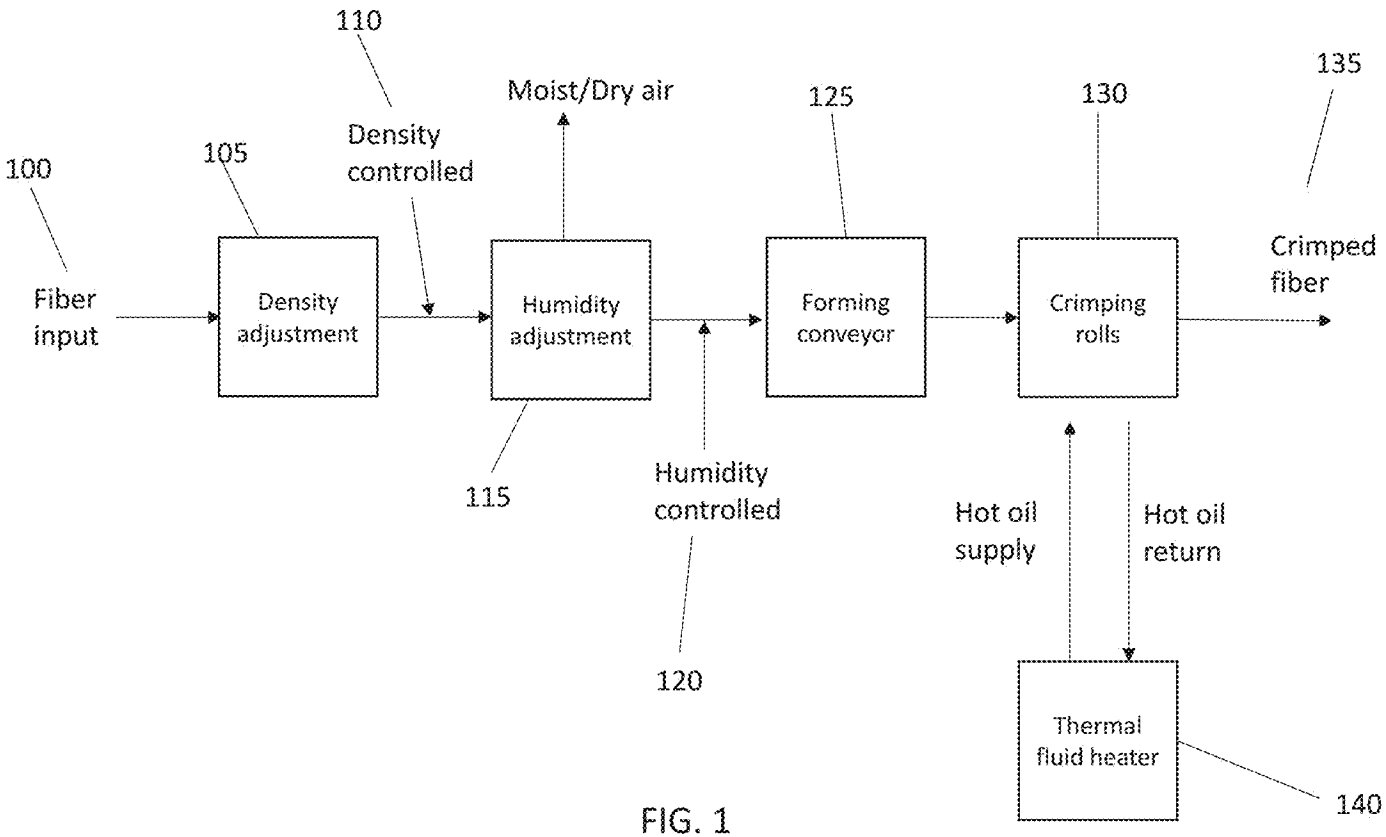
FIG. 1 is a flow chart illustration of a method of providing crimped bast fibers according to one embodiment of the present disclosure.

The following definitions are presented for use in the interpretation of the claims and specification of the instant invention. Terms such as "comprising", "comprises", "including", "including but not limited to", "contains", "containing" are not to be considered as limiting or exclusive as related to the claimed invention. "A" and "an" are not be considered as indication enumeration when preceding an element or component. The terms "invention", "present invention" or "instant invention" are not limiting terms and are used to convey and incorporate all aspects described and discussed in the claims and the specification. The term "about" used as a modifier of a quantity refers to variations as are known and understood to occur in measuring and handling procedures as are known to those skilled in the arts of textile science and engineering. Additional definitions of technical terms and references follow.

Any ranges cited herein are inclusive. The term "about" used throughout is used to describe and account for small fluctuations. For instance, "about" may mean the numeric value may be modified by ±5%, ±4%, ±3%, ±2%, ±1%, ±0.5%, ±0.4%, ±0.3%, ±0.2%, ±0.1% or ±0.05%. All numeric values are modified by the term "about" whether or not explicitly indicated. Numeric values modified by the term "about" include the specific identified value. For example, "about 5.0" includes 5.0.

Cellulosics, and cellulosic fibers refer to natural fibers or to synthetic fibers which are chemically ethers or esters of cellulose. Such natural fibers are obtained from the bark, wood, leaves, stems, or seeds of plants, while synthetic cellulosic fibers are manufactured from digested wood pulp and may include substituted side groups to the cellulose molecule that provide specific properties to those fibers.

Bast fibers are natural fibers obtained from the phloem or bast from the stem of certain plants, including but not limited to jute, kenaf, flax and hemp. The bast fibers are initially recovered as bundles of individual fibers which are adhered by pectin, which must be subsequently removed to some degree to allow the bast fibers to be processed further.

Crimp is the naturally occurring convolution of waviness of a fiber, or that same property induced by chemical or mechanical means, such as crimping of synthetic fibers. The imposition of crimp to a specific frequency, as defined by a number of crimps per unit of fiber length, may generate an overall fiber having a defined crimp profile, e.g., having a defined number of crimps per cm.

Natural fibers are those sourced directly from plants, animals, or minerals, noting that such fibers may require specific pre-processing in order to render them useful for textile manufacturing purposes. Synthetic fibers are those produced through polymerization processes, using naturally occurring and sustainably sourced raw materials or petroleum derived raw materials.

Staple fibers are fibers with a discrete length and may be natural or synthetic fibers. Continuous fibers have an indeterminate or difficult to measure length, such as silk or those from certain synthetic fiber spinning processes. Fibers of any length may be cut into discrete lengths and that cut product is then referred to as a staple fiber.

Airlaid, sometimes referred to as air laid, is a process for producing a fibrous mat or batt using short or long staple fibers, or blends of the same. In this process, air is used to transfer the fibers from the fiber opening and aligning section of the process and to then to convey those fibers to a forming surface where the fibrous mat or batt is collected and then subjected to a further step of bonding or consolidating to produce an airlaid nonwoven fabric.

Drylaid, sometimes referred to as dry laid, is a process for producing a fibrous mat or batt by a process using mechanical fiber opening and alignment, such as carding, where the fibrous mat or batt is transferred by mechanical means rather than by means of air to a conveyor surface, where the fibrous mat or batt is then subjected to a further step of bonding or consolidating to produce a drylaid nonwoven fabric.

Wetlaid, sometimes referred to as wet laid, is a process for producing a fibrous sheet through means similar to paper making where the fibers are suspended in an aqueous medium and the web is formed by filtering the suspension on a conveyor belt or perforated drum. Depending on the end use application and fibers used to produce the fabric, some means of bonding or consolidating may be required to achieve final properties in the fabric.

Bonding or consolidation of fibrous mats or batts is a processing step that is common among the various technologies for producing nonwoven fabrics. The means of bonding or consolidation are commonly considered as being mechanical, thermal or adhesive, with several distinct methodologies existing under each of those headings. In general, mechanical means rely on creating entanglements between and among fibers to produce desired physical properties, where needlepunch and hydroentangling are nonexclusive examples of those means. Thermal bonding uses the thermoplastic properties of at least some fibers included in the fabric, such that the application of heat with or without pressure causes a portion of the fibers to soften and deform around each other and/or to melt and form a solid attachment between and among fibers at points of crossover when the thermoplastic material has cooled and solidified. Adhesive means use the application of adhesive in some form to create a physical bond between and among fibers at points of crossover, such means nonexclusively include liquid adhesives, dry adhesives, hot melt adhesives. These adhesives may be applied to mats or batts as sprays and foams, or via methods known in the art including but not limited to dip-and-squeeze or gravure roll.

A percentage by weight, in reference to a fabric, is the weight of given solid component divided by the total weight of the fabric, expressed as a percentage of the fabric weight.

Strength-to-weight ratio is an expression of a normalized tensile strength value for a fabric where the tensile strength of the fabric can then be considered relative to similar fabrics without the impact of basis weight differences between or among sample fabrics or grades of fabrics. Because basis weight alone can influence tensile strength values for a given fabric, the strength-to-weight ratio allows for an assessment of the impact on the strength of a fabric contributed by the inclusion of a specific fiber or a change in the process parameters, as non-exclusive examples of the usefulness of that metric.

Loft relies upon the properties of bulk and resilience for a fabric. In technical terms, bulk is the inverse of density, while in common usage bulk is equated to simple fabric thickness. Resiliency is the ability of a fabric to resist permanent compression, with loss of volume, following application of an areal load.

As noted above, the raw material of bast fibers (e.g., such as the phloem or bast from the stem of certain plants, including but not limited to jute, kenaf, flax and hemp) can be sourced from various primary global processors. In some embodiments, the bast fibers may have been mechanically or chemically cleaned to receive a trash content therein of about 0.1% to about 10% by weight. In some embodiments, the mechanically or chemically cleaned fibers may have a staple length of about 1 mm to about 100 mm.

In some embodiments, bast fibers utilized in this disclosure can be individualized via mechanical or chemical cleaning. Mechanical cleaning of bast fibers occurs during a process called scutching or decortication. During this process the plant stems are broken and combed to remove non-bast components such as particles from the plant's xylem tissue and general debris. For example, the bale of bast fiber may be unrolled into the machine and then breaker rolls may split the stems and expose the fiber bundles. Further, rotating combs may be used to clean the fiber of all trash and non-fiber material before discharging fibers to a separate collection area. Decortication is a similar process that utilizes pinned cylinders in place of rotating combs. Mechanical cleaning individualizes the bast fibers and removes less pectin than chemically cleaning.

Mechanically cleaned fibers have typically had a portion of the pectin removed from the fiber prior to mechanical processing through a process known as "retting" and are therefore considered by this application to be pectin-reduced. The residual level of pectin/contaminants vary from geographic region and growing season and depends on the natural retting of the fiber and the number of rotating combs/pinned rollers that the fiber is subjected to. Mechanically cleaning bast fibers is commonplace and grades of pectin-reduced fiber are known to those skilled in the art.

Chemical cleaning of bast fibers occurs in several ways: water retting, chemical cleaning, or enzymatic cleaning. Processes for chemically cleaning the bast fibers may, in some embodiments, be referred to as being chemically scoured to remove pectin, lignin, and other non-cellulosic materials. Natural chemical cleaning, called water retting, occurs in pools or streams whereby the bast fiber stalks are placed in the water for a period of several days to a week or more. Natural microbes remove the pectin from the fiber, resulting in clean, pectin-reduced, individualized bast fiber. Chemical cleaning is a faster process and is performed on mechanically cleaned bast fibers and in an industrial facility possessing equipment capable of working at greater than atmospheric pressure and with temperatures ranging from 80° C. to over 160° C. The bast fiber is subjected to heat, pressure, and a chemical solution such as caustic soda or other cleaning agents to quickly remove pectin and lignin. Enzymatic cleaning is very similar to chemical cleaning with a portion of the caustic soda and other chemical agents being replaced by enzymes such as pectinase or protease. Once cleaned, the bast fibers are optionally de-watered via centrifuge and/or air dryers to a pre-set moisture content of about 2% to about 20% by weight. In embodiments where the cleaned bast fibers are not de-watered, they may be provided in the form of a slurry and may optionally be dried to the desired moisture content prior to crimping of the fibers.

Chemically cleaned bast fibers are considered by the industry to be substantially free of pectin. US2014/0066872 to Baer et al., which is incorporated by reference herein, describes fiber with substantially reduced pectin as having less than 10%-20% by weight of the pectin content of the naturally occurring fibers from which the substantially pectin-free fibers are derived.

One aspect of the present disclosure relates to crimped bast fibers and methods of providing crimped bast fibers which may optionally be incorporated in nonwoven fabrics and or various types of textile products, which will be discussed further herein.

In some embodiments of the present disclosure, a method of forming crimped bast fibers is provided. In such embodiments, the method of forming crimped bast fibers may include providing an input of bast fibers (e.g., such as the mechanically or chemically cleaned bast fibers described herein above) that is adjusted to a desired density to provide a density-controlled fiber; adjusting the moisture content of the density-controlled fibers to be in the range of about 10% to about 40% by weight, or about 15% to about 20%; forming a fiber mat from humidity controlled fibers on a forming conveyor; and contacting the fiber mat with a pair of heated crimping rolls to provide crimped bast fibers having a crimp of about 2 to about 10 crimps per centimeter, the pair of heated crimping rolls comprising a first crimping roll being positioned proximate to the top side of the fiber mat and opposing a second crimping roll positioned proximate to the bottom side of the fiber mat.

As depicted in FIG. 1, a fiber input is provided at operation 100 that can be optionally adjusted to a desired density at operation 105 to provide density-controlled fibers 110. In some embodiments, the density adjustment step may comprise subjecting the input of bast fibers to a fiber opener to provide opened bast fibers. Such opening process are generally advantageous as they can help maximize the fiber surface area which enables a uniform fiber mat to be created prior to forming of the fiber mat. Uniform distribution of the fiber mat can improve crimping control during the crimping step. In some embodiments, the fiber opener may be run at varying speeds and it should be noted that using lower speeds may produce less damage to the bast fibers themselves. Examples of fiber openers suitable for the processes described herein are commercially available from Trützschler GmbH & Co. KG.

In some embodiments, the density adjustment step may further comprise extracting excess air from the opened bast fibers using an air separator following the fiber opening step. It is noted that the fiber opener typically operates at a very high revolutions-per-minute (RPM) and that this generates excess amounts of air. Thus, excess air can be extracted from the opened fibers using an air separator upon exiting the fiber opener. Examples of air separators suitable for the processes described herein are commercially available from Temafa Maschinenfabrik GmbH.

As noted above, the moisture content of the density-controlled fibers 110 may undergo a moisture content adjustment 115 following the optional density adjustment step to provide a humidity controlled fiber 120 with a moisture content in the range of about 10% to about 40% by weight, or preferably about 15% to about 20%. In some embodiments wherein the input fibers are provided in a slurry form (e.g., such as bast fibers that have been chemically scoured in a water-based system), the humidity adjustment step may comprise heating the saturated fibers to reduce the moisture content into the desired range. In such embodiments, heating of the fibers may be achieved by using a hood dryer configured to remove moisture from the saturated fibers prior to the forming step.

Alternatively, in some embodiments wherein the input fibers are provided in a relatively dry form (e.g., such as low moisture content bales of bast fibers), the humidity adjustment step may comprise subjecting the fiber mat to steam conditioning to achieve the desired moisture content. In such embodiments, the steam conditioning may comprise contacting the dried fibers with saturated steam at atmospheric pressure. Steam conditioning of the dried fibers may be provided using a customized hood (e.g., such as a fogging tunnel) configured to inject steam into the enclosed area surrounding the fibers. It should be noted that the bast fibers provide high absorbency characteristics and thus readily absorb moisture from the steam.

As noted above, a fiber mat may be formed on a forming conveyor at operation 125. In some embodiments, the fiber mat may be formed using conventional air-laid or dry-laid mat forming techniques and technologies. In some embodiments, the fiber orientation on the conveyor may be generally isotropic. The basis weight of the fiber mat formed on the conveyor may vary and can be adjusted by varying the speed of the in-feed conveyor or the forming conveyor. A typical basis weight range may be in the range of about 10 $g/m^2$ to about 100 $g/m^2$, about 25 $g/m^2$ to about 75 $g/m^2$, or about 40 $g/m^2$ to about 60 $g/m^2$. It should be noted that higher basis weights may also be used but will result in lower percentages of fibers being crimped, specifically, as fibers nearest the crimp roll surface are more easily crimped.

In some embodiments, the conveyor may optionally comprise one or more additional components capable of altering the thickness or uniformity of the mat formed at operation 125 and prior to crimping 130. In some embodiments, the forming conveyor may further comprise one or more weighted rollers or belts configured to compress the fiber mat or to provide a uniform sheet profile prior to the crimping step. For example, the one or more weighted rollers or belts may be positioned downstream of the initial gravity forming section of the conveyor, such that the gravity formed fiber mat is compressed to reduce thickness and improve uniformity in the z-direction. Examples of forming conveyors and additional components suitable for the processes described herein are commercially available from Trützschler GmbH & Co. KG.

In some embodiments, the fiber mat may undergo a crimping step following the forming step. As illustrated at operation 130 of FIG. 1, the formed fiber mat may be fed to a pair of heated crimping rolls that are configured to produce a crimped fiber mat 135. As noted above, the pair of heated crimping rolls typically provide crimped bast fibers having a crimp of about 2 to about 10 crimps per centimeter. In some embodiments, the pair of heated crimping rolls may comprise a first crimping roll being positioned proximate to the top side of the fiber mat and opposing a second crimping roll positioned proximate to the bottom side of the fiber mat. Although only one set of crimping rolls can be used in certain embodiments of the present disclosure, multiple sets of crimping rolls could also be used, and the angle between the crimping rolls and the in-feed direction of the fiber mat can vary. In certain embodiments, the crimping rolls are approximately perpendicular to the in-feed direction of the fiber mat, but other orientations could also be used.

In some embodiments, the heated crimping rolls comprise indentations along the surface thereof which are configured to deliver the specific crimp patterns desired in the crimped fiber mat. Such indentations or patterns may be machined circumferentially onto one or more of the heated crimping rolls. In some embodiments, the crimp roll pairs are mated to fit into one another when pressed together to impart the crimp. Alternatively, in some embodiments it is possible for only one of the crimping rolls to have the crimped profile with the other roll having a smooth surface. In some embodiments, the crimp roll speed may be matched to the forming conveyor to avoid shearing of the fibers within the mat.

In some embodiments, the indentations or pattern on the crimping rolls may be machined across the roll face instead of circumferentially around the roll face. In such embodiments, this makes the alignment of peaks and grooves more difficult between the top and bottom rolls; however, it should be noted that this may improve crimp uniformity when fiber mats are mechanically stretched in the machine direction (e.g., by a series of progressively faster turning rollers or belts).

Figure 2:
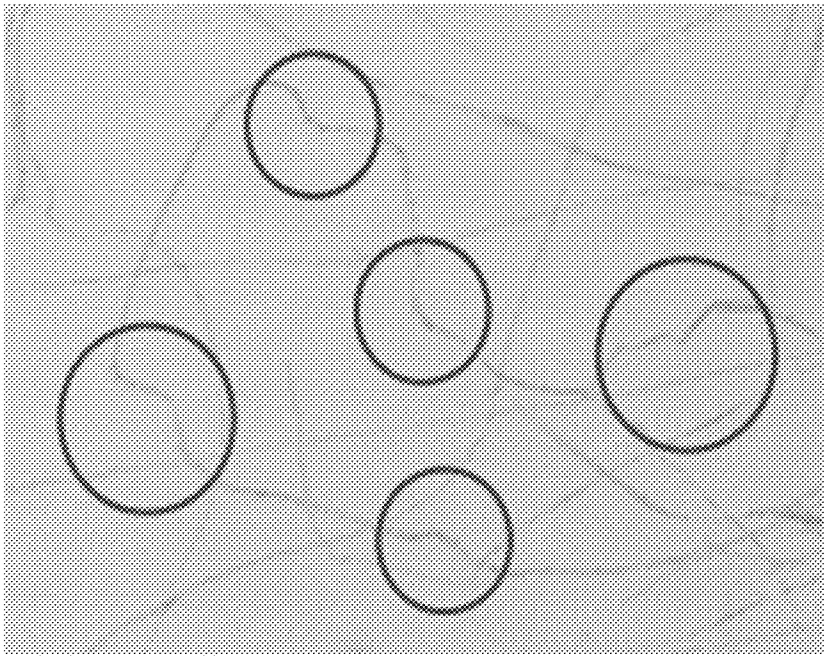
FIG. 2 is a microscope image of a crimped bast fiber according to an embodiment of the present disclosure.

In some embodiments, the angle, pitch, and/or profile of the crimped rollers can be varied to achieve different cohesion and bulk properties. For example, in some embodiments, the individual crimps in the crimped bast fibers may be substantially triangular, substantially sinusoidal, substantially rectangular, or wave-like in shape. FIG. 2, for example, illustrates microscopic images of bast fibers that have been subjected to crimp. The circles provided therein indicate various crimps appearing in the image.

Figure 3:
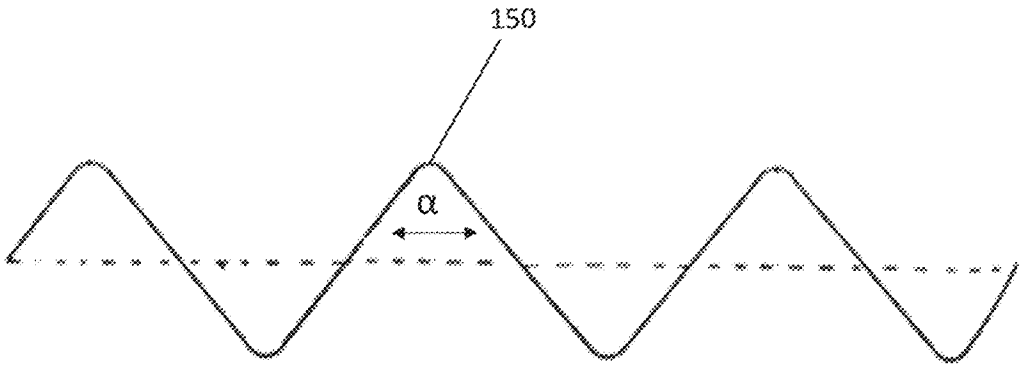
FIG. 3 is an illustration of a fiber with a planar crimp.

FIG. 3, for example, shows a diagram of a mechanical planar crimp. Crimp angle and number of crimps per centimeter are determined by the method of mechanical crimping. In some embodiments, the individual crimps have a crimp angle (e.g., depicted by the angle $\alpha$ in FIG. 3) in the range of about 30° to about 150°, or about 60° to about 120°, as measured from the tip 150 of the substantially triangular crimp. In some embodiments the crimped fiber mat may comprise at least 2 crimps per linear cm, at least 4 crimps per linear cm, at least 6 crimps per linear cm, or at least 8 crimps per linear cm.

In some embodiments that pair of crimping rolls may be configured to maintain a temperature of between about 100° C. to about 250° C., such as about 120° C. to about 180° C., or about 130° C. to about 170° C.

In some embodiments, the pair of crimping rolls may be configured to maintain a temperature of at least about 100° C., at least about 150° C., or at least about 200° C. As illustrated in FIG. 1, the crimping rolls may be connected to a heater 140 which heats the crimping rolls. The types of heaters may vary and generally includes any heater which may be configured to deliver constant heat to the outer surface of the crimping rolls. As shown in FIG. 1, a thermal fluid heater 140 may be used which pumps oil continuously throughout the crimping rolls so as to maintain a constant surface temperature of the crimping rolls. Examples of some circulation heaters suitable for the processes described herein are commercially available from Wattco Inc.

In some embodiments, the pair of heated crimping rolls are configured to apply a force to the steamed fiber mat of about 5 $lb_f$ per linear inch to about 100 $lb_f$ per linear inch. It should be noted that the degree and the extent of the crimp is dictated by the force applied by the crimping rolls. In some embodiments, the heated crimping step may further comprise an air compressor and a pneumatic cylinder connected to the pair of crimping rolls and configured to control the force applied by the pair of crimping rolls to the fiber mat. In such embodiments, the air compressor and the pneumatic cylinder may be configured to adjust either the first crimping roll and/or the second crimping roll so as to control the pressure applied to the fiber mat. In some embodiments, the contacting step may comprise two or more pairs of heated crimping rolls.

Figure 4:
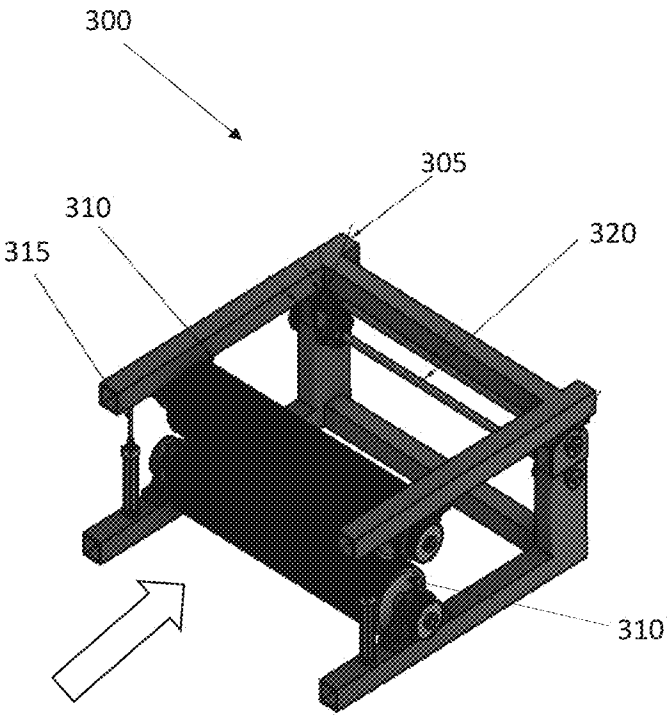
FIG. 4 is an illustration of a crimping assembly including a pair of heated crimping rolls according to an embodiment of the present disclosure.

FIG. 4 illustrates a crimping assembly capable of crimping a fiber mat as noted above. As shown in FIG. 4, the crimping assembly 300 includes a frame 305 and a pair of crimping rolls 310 that may optionally be heated and/or configured to apply a force to the fiber mat. Generally, it should be noted that the number of crimping rolls used in the methods described herein may vary. For example, in the depicted embodiment a single pair of crimping rolls is shown; however, one or more additional pairs of crimping rolls may be included in the crimping assembly. In some embodiments, the crimping rolls may be internally heated to a temperature in the range of about 100° C. to about 250° C., about 120° C. to about 180° C., or about 130° C. to about 170° C. In some embodiments, the crimping assembly may include air cylinders 315 on opposing ends of the pair of crimping rolls 310 that are configured to apply a force to the fiber mat (via the crimping rolls). In some embodiments, a force of up to about 100 $lb_f$ per linear inch may be applied to the fiber mat via the crimping rolls. Generally, the air cylinders may be configured to apply a force of at least 5 $lb_f$ per linear inch, at least 40 $lb_f$ per linear inch, at least 60 $lb_f$ per linear inch, or at least 80 $lb_f$ per linear inch, to the fiber mat during operation. In some embodiments, the crimping assembly may optionally include a transmission drive shaft 320 as part of the transmission system conveying power to the crimping rolls 310. It should be noted that the crimping assembly depicted in FIG. 4 and any of the process parameters described herein may be used additionally, or alternatively, to the crimping step in any of the methods described herein.

Figure 5A:
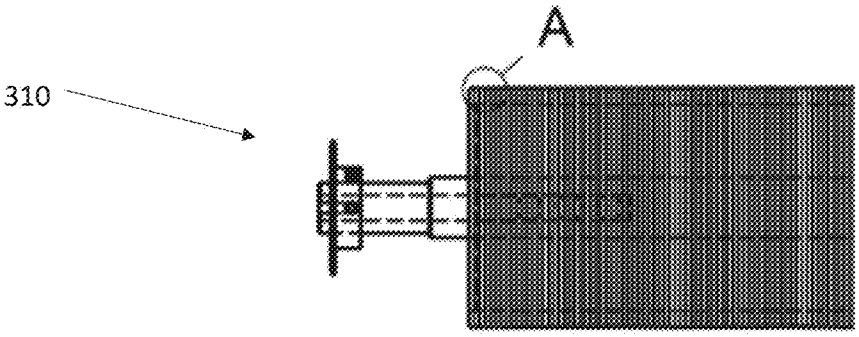
FIG. 5A illustrates a cut-away view of a portion of a single crimping roll having a radial crimping pattern machined thereon according to an embodiment of the present disclosure.

As noted above, in some embodiments, indentations and/or grooves may be machined circumferentially onto one or both of the crimping rolls 310. For example, FIG. 5A shows a cut-away view of a portion of a crimping roll that has been machined circumferentially to provide radial grooves thereon. In the depicted embodiment, the machined grooves are shown as being in the machine direction (MD), for example, such that the grooves are oriented parallel to the machine direction of the fiber mat. However, other configurations are possible. For example, the machined grooves may be oriented in the cross direction (CD), such that the grooves are oriented perpendicular to the machine direction of the fiber mat, in some embodiments.

Figure 5B:
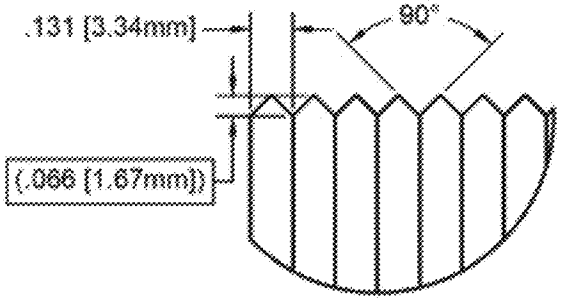
FIG. 5B illustrates a cut-away view of detail A in FIG. 5A highlighting the angle and dimensions of the radial grooves on a crimping roll according to an embodiment of the present disclosure.

FIG. 5B shows a cut-away view of detail A in FIG. 5A. As shown in FIG. 5B, the machined grooves on the exterior of the crimping roll form a substantially triangular shape that imparts a crimp on the individual fibers in the fiber mat during operation. As noted above, the angle of these grooves may vary in the range of about 30° to about 150°. In the depicted embodiment, for example, the angle of the crimping grooves is about 90°. Generally, the dimensions of the grooves may vary based on the desired angle of the grooves and/or based on the desired number of crimps per centimeter. In the depicted embodiment, for example, the height of the individual grooves is about 1.67 mm and the distance interval between the grooves is about 3.34 mm. In other embodiments, the height of the individual grooves may be in the range of about 1 mm to about 3 mm and the distance interval between the grooves may be in the range of about 2 mm to about 5 mm. It should be noted that the particular crimp profile selected may have an impact on crimp performance and, ultimately, the fiber strength within the fiber mat. In some embodiments, for example, the crimp angle may be decreased, increasing the overall number of crimps, which would increase the height of the crimp without affecting the number of crimps per fiber. In such embodiments, the cohesion properties of the higher amplitude crimped fibers may be increased. In other embodiments, the crimp profile may be chamfered (e.g., by reducing the definition of the grooves) which may reduce crimp definition while maintaining fiber strength at higher crimping pressures.

Figure 6A:
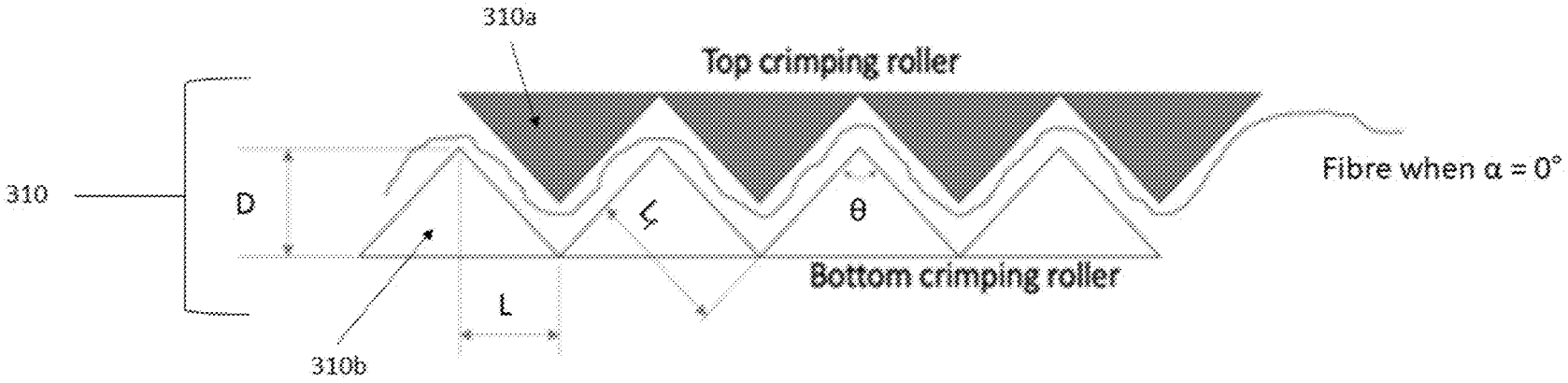
FIG. 6A illustrates a single fiber being crimped between a pair of crimping rolls according to an embodiment of the present disclosure.

FIG. 6A shows a single fiber being crimped between a pair of crimping rolls 310*a*, 310*b*. In the depicted embodiment, the groove pattern has been machined circumferentially into the crimping rolls (e.g., as noted above) and the top crimping roll 310*a* is offset from the bottom crimping roll 310*b* such that the peak of the top crimping roll is aligned with the trough of the bottom crimping roll and vice versa. While only a single fiber is shown in the depicted embodiment, it should be understood that this single fiber may also represent the entire fiber mat and in such an example, the machine direction (MD) of the fiber mat is understood to be perpendicular to the depiction of the fiber (e.g., MD is into the page).

Figure 6B:
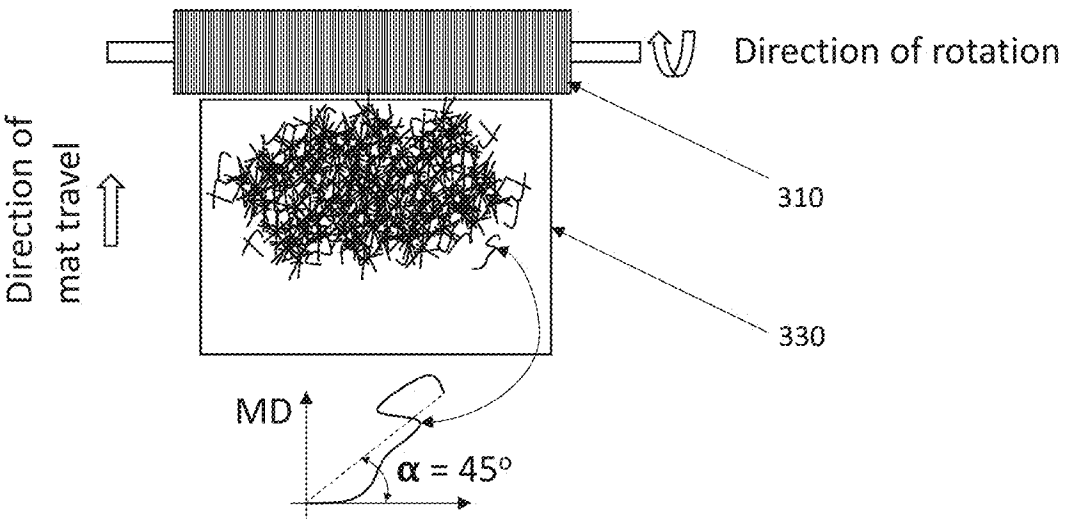
FIG. 6B illustrates a fiber mat entering a crimping assembly, including the orientation of the fibers in the fiber mat, according to an embodiment of the present disclosure.

Such an example is illustrated in FIG. 6B which shows an overhead view of a fiber mat 330 entering a pair of crimping rolls 310. As noted in FIG. 6B, the direction of movement of the fiber mat is substantially parallel with the axis of rotation of the crimping rolls. Generally, the orientation of the individual fibers in the fiber mat may vary. For example, the fiber depicted in FIG. 6A is shown to be substantially parallel to the axis of rotation of the crimping rolls. However, as noted above, during formation of a nonwoven fabric, the fibers within the fibrous mat are randomly oriented and arranged therein. For example, the angle of the fibers within the mat (e.g., in relation to the axis of rotation of the rolls) may vary between 0° and 90°. It should be noted, however, that fibers that have been randomly oriented within a fibrous mat may present themselves, on average, at an angle of about 45°. Further, the angle presented along the length of any individual fiber will vary, for example, because the fibers themselves may not be straight along their length. Thus, in some embodiments, such variations in the fiber profile within the fiber mat may result in variations in the crimp imparted to any individual fiber. However, the average crimp imparted to all of the fibers within the fiber mat is reproducible and consistent.

Generally, various process parameters may be used in calculating and predicting the particular crimp profile imparted on a fiber mat. For example, these parameters include the number of crimps per cm roll length ($N_a$), the length between crimps along the axis of the crimp rolls (L), the crimp angle machined into the crimping rolls (θ), the average angle between fiber and cross-direction (α), the length between crimps measured along the length of the fiber ($L_f$), the groove depth on the crimping rolls (D), the fiber length (F), and the number of crimps per fiber ($N_f$). During operation of a crimping assembly as described herein, these parameters can be calculated using the below equations.

$$L = \frac{1}{N_a} \quad L_f = \frac{L}{\sin\frac{\theta}{2} * \cos(\alpha)} \quad D = Lf * \cos\frac{\theta}{2} \quad N_f = \frac{F}{L_f} \qquad \text{Equations}$$

Table 1 below shows how the particular crimp profile is calculated for fibers that enter the crimping rolls perfectly parallel to their axis of rotation (e.g., α=0°) and for fibers that enter the crimping rolls at an average angle of 45° as would be expected in a randomly oriented fiber mat (e.g., α=45°).

TABLE 1

| symbol | description | units | α = 0° | α = 45° |
|---|---|---|---|---|
| $N_a$ | Number of crimps per cm roll length | # | 5.0 | |
| L | Length between crimps (along axis) | cm | 0.200 | |
| θ | Crimp angle machined into rollers | degrees | 90 | |
| α | Average angle between fibre and cross-machine direction (CD) | degrees | 0 | 45 |
| $L_f$ | Length between crimps (along fibre) | cm | 0.283 | 0.400 |
| D | Groove depth on crimping roll | cm | 0.200 | |

TABLE 1-continued

| symbol | description | units | α = 0° | α = 45° |
|---|---|---|---|---|
| F | Fibre length | cm | 5.0 | 5.0 |
| $N_f$ | Number of crimps per fibre | # | 17.7 | 12.5 |

As shown in Table 1, the number of crimps per fiber decreased for fibers having an angle of 45° when compared to fiber having an angle of 0° (e.g., where the fiber enters the crimping rolls perfectly parallel to the axis of rotation). As expected, this decrease in the number of crimps per fiber led to an increase in the overall length between crimps for fibers having an angle of 45° when compared to fiber having an angle of 0°.

In some embodiments, the bast fibers may optionally be pre-treated with various coatings (e.g., such as salts, polymers, resins, etc.) prior to crimping in order to improve crimp retention. For example, in some embodiments thermoplastic polymers may be used to coat the fibers and, in such embodiments, it may be preferable to preheat the mat before crimping with chilled crimping rollers. In such embodiments, the fiber mat must be heated above the melting temperature of the polymer coating in order to provide the desired adhesion. In such embodiments, the mat is subsequently cooled by the chilled crimping rollers which may allow for the crimps to be set in the bast fibers.

In some embodiments, the crimped bast fibers may optionally be dried following the crimping step to a moisture content of about 5% to about 20% based on the total weight of the crimped bast fibers following the contacting step. In some embodiments, the crimped bast fibers may be dried using a mat dryer.

Figure 7:
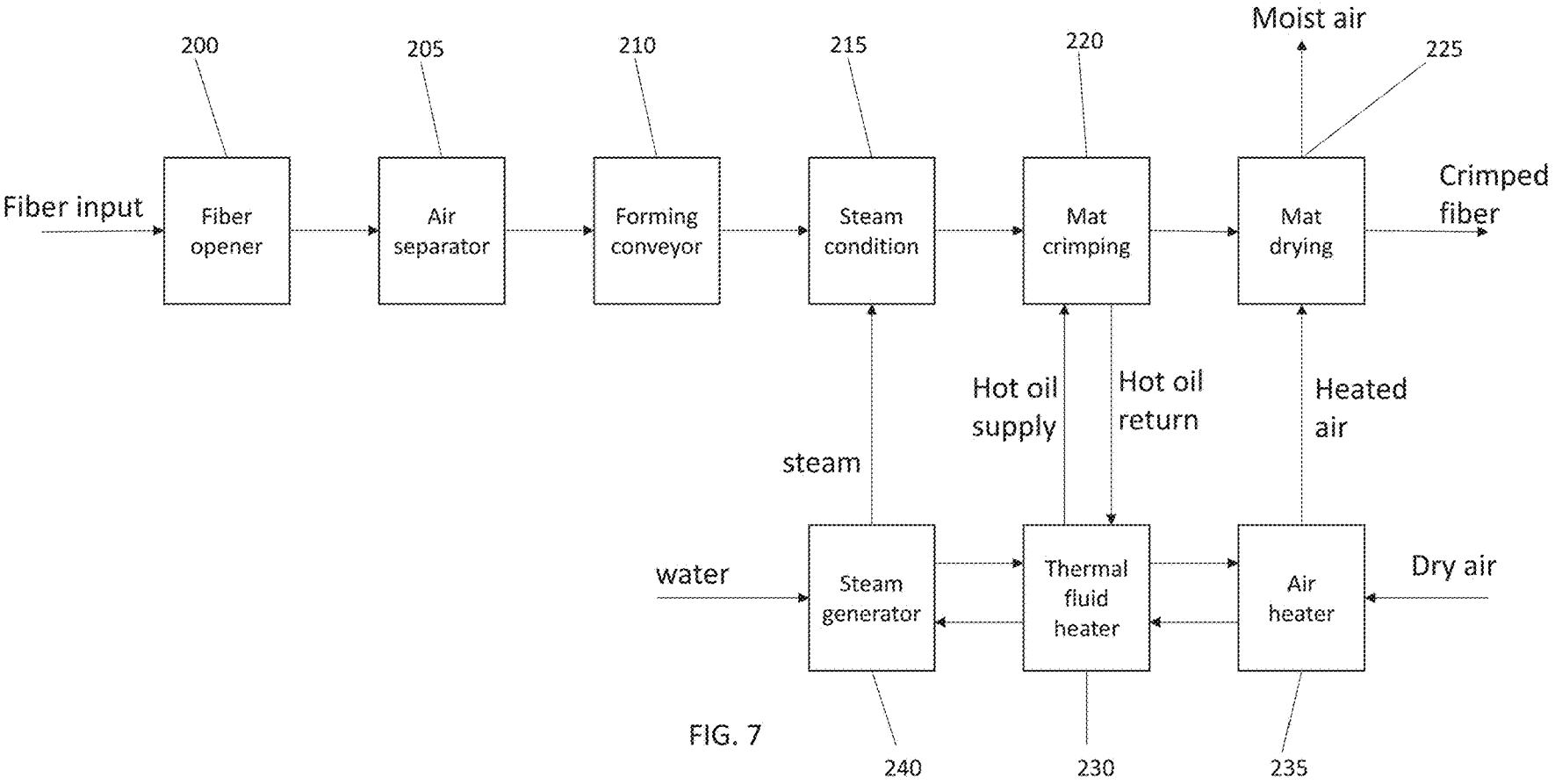
FIG. 7 is a flow chart illustration of a method of providing crimped bast fibers according to one embodiment of the present disclosure.

As noted above, in some embodiments wherein the input bast fibers are provided as dry baled fibers, the humidity adjustment step may comprise steam conditioning the dried fibers to provide humidity-controlled fibers prior to crimping. FIG. 7, depicts such an embodiment comprising use of a fiber opener 200, an air separator 205, and a forming conveyor 210; followed by a steam conditioning step 215, a crimping step 220, and a drying step 225 to provide a crimped fiber. In the depicted embodiment, use of any of the fiber openers, air separators, and forming conveyors as described herein above may be suitable for use according to this aspect of the disclosed embodiment.

Further, as illustrated in FIG. 7, the steps of steam conditioning the fiber mat, crimping the fiber mat, and drying the fiber mat can be provided as a closed loop system, which promotes increased efficiency and reduces heat and energy loss. For example, a thermal fluid heater 230, such as those described herein above, may be connected to an air heating apparatus 235 and a steam generation apparatus 240 in a closed loop system. In such an embodiment, the thermal fluid heater is configured to heat a flowing liquid (e.g., such as oil) that circulates through the crimping rolls and the steam generator to provide the necessary heat for both the steam conditioning step and the crimping step. The steam generator may further comprise a boiler that is connected to an input water line and configured to generate steam by heating the incoming water. When the heated liquid enters the boiler and comes into contact with the water input, steam is formed which is separately transferred to the steam conditioning step. The heated liquid that leaves the boiler may then be combined with the out flow of the liquid from the crimping rolls. Further, an air heating apparatus comprising an input of dry air is provided which may also be looped into the closed system including the steam generator and the boiler. For example, the system may further provide for circulation of the heated liquid from the thermal fluid heater through the air heater such that the heated liquid comes into contact with the dry air and heats the air contained therein such that dray air is separately transferred to the drying step.

In some embodiments, the methods provided for herein may further comprise a bale opener which opens bales of chemically or mechanically cleaned bast fibers prior to providing the fiber input. Using the bale opener may help reduce the fiber bales into smaller more manageable chunks that can be distributed evenly along an in-feed conveyor. In some embodiments, an in-feed conveyor may be provided following the bale opener which is configured to meter the amount of fiber material that is transferred to the forming conveyor or, alternatively, may meter the amount of fiber material that is transferred to one or more optional steps prior to forming (e.g., to a fiber opener/air separator). In some embodiments, the speed of the in-feed conveyor may additionally be controlled in order to control the basis weight of the fiber mat on the forming conveyor. Examples of bale openers suitable for the processes described herein are commercially available from Trützschler GmbH & Co. KG.

As noted above, the method described herein also includes forming nonwoven fabrics which advantageously incorporate the crimped bast fibers prepared according to the methods described herein above. In some embodiments, bast fiber nonwoven fabrics may be formed and bonded by a variety of methodologies and means well known in the industry, where those nonwoven fabrics comprise about 5% to about 100% by weight of the crimped bast fibers having a mean fiber length of at least 6 millimeters, where the bast fibers are substantially pectin free. In some embodiments, the crimp level of the crimped bast fibers in the nonwoven fabric has been induced by one of the methods described herein to produce a crimped fiber with about 2 to 10 crimps per centimeter.

The inclusion of crimp bast fibers in at least a minority portion of the total weight of fibers in the bast fiber nonwoven fabrics and textile products, provides improved processing efficiency and improved physical properties of those fabrics as compared to similarly formed fabrics with the same portion of straight bast fibers. The improved physical properties include but are not limited to the fabric strength-to-weight ratio, possible inclusion of higher bast fiber contents, increased processing efficiency, increased absorbency, and/or increased fabric loft or haptic properties.

In one embodiment of the invention, the nonwoven fabric contains at least about 5% by weight of crimped bast fibers, with a majority of other staple fibers selected from natural or synthetic fiber types. This bast fiber nonwoven fabric of this embodiment exhibits the described improvement in physical properties as compared to a bast fiber nonwoven fabric that does not include crimped bast fibers.

In some embodiments of the application, the crimped bast fibers may be blended with one or more other types of natural or synthetic staple fibers at a weight percent of at least about 5% to 49% crimped bast fibers with a mean length of greater than 6 mm to form the nonwoven fabric.

In another embodiment, the crimped bast fibers may be blended with one or more other types of natural or synthetic staple fibers at a weight percent of at least about 51% to 100% crimped bast fibers with a mean length of greater than 6 mm to form the nonwoven fabric, with the other natural or synthetic fibers comprising about 49% to 0% of the fabric weight.

In some embodiments, the inclusion of at least about 5% by weight of the crimped bast fibers with a mean length of greater than 6 mm in the fabric provides an improvement in the strength-to-weight ratio and improved loft as compared to other similarly manufactured bast fiber containing nonwoven fabrics where those bast fibers are essentially straight and do not exhibit crimp.

It is a further embodiment of the invention that the one or more types of natural fibers included in a blend with the crimped bast fibers may include bast fibers that do not exhibit a minimum of 1 crimp per centimeter of fiber length.

It is an aspect of the present invention that the crimped bast fiber nonwoven fabric may be produced by any of the drylaid, airlaid or wetlaid nonwoven technologies and may be bonded or consolidated by any of the adhesive, mechanical or thermal bonding means. It is understood that such means may be used in combination to produce the final fabric form, where for example a carded mat or batt might be combined with an airlaid mat or batt where either layer or the laminate may be subjected to one or more of the bonding or consolidating means in order to produce the desired physical and aesthetic properties of the final fabric.

In certain embodiments, the bast fiber nonwoven fabric may be a laminate of at least two nonwoven fabrics in a laminate where at least one fabric of the laminated comprises at least 5% of crimped bast fibers and where each of the fabrics may be formed by drylaid, airlaid or wetlaid forming processes and where each of the fabrics may be bonded by thermal, mechanical or adhesive means prior to forming the laminate configuration.

It is an aspect of the present invention that the controlled crimp bast fiber nonwoven fabrics as described herein will be find use end product applications including but not limited to baby wipes, cosmetic wipes, perinea wipes, disposable washcloths, kitchen wipes, bath wipes, hard surface wipes, glass wipes, mirror wipes, leather wipes, electronics wipes, disinfecting wipes, surgical drapes, surgical gowns, wound care products, protective coveralls, sleeve protectors, diapers and incontinent care and feminine care articles, nursing pads, air filters, water filters, oil filters, furniture or upholstery backing.

In addition to the various types and methods of nonwoven fabrics that can be provided according to the present disclosure, the crimped bast fibers and methods described herein may further be useful in a variety of different textile applications. For example, the fibers and methods provided herein may be useful in spun yarn applications, e.g., such as open end spinning, ring spinning, air jet spinning, and the like, and fabrics made from yarns spun using these methods. Textile yarns prepared according to these various different methods may comprise at least about 5% of crimped bast fibers. In some embodiments, such textile yarns may comprise crimped based fibers in amounts in the range of about 5% to about 100% by weight.

In some embodiments, the crimped bast fibers may be combined with various other natural, synthetic, and/or regenerated cellulose fibers. In some embodiments, the crimped bast fibers may be combined with other fibers, including, but not limited to, cotton; wool; animal hair; polyesters; and regenerated man-made cellulosic fibers ("MMCF") such as rayon or Tencel®, and combinations thereof. Such textile applications may further provide for varying yarn counts and end uses, for example, home textiles, apparel, footwear, upholstery, geotextiles, medical textiles, industrial textiles, and towels. Advantages of using crimped bast fibers in spun yarn application are improved processability of the fibers through the card due to enhanced cohesion, and stronger yarn. For example, stronger yarn may allow for finer yarn counts, easier knitting and weaving, and/or higher quality end garments.

The foregoing is considered to provide examples of the principles of the invention. The scope of modifications as may be made to the invention are not limited beyond that imposed by the prior art and as set forth in the claims herein.

EXPERIMENTAL

Testing was conducted to evaluate the strength properties of a nonwoven fabric made with uncrimped bast fibers (referred to herein as the "control fabric") versus a nonwoven fabric comprising crimped bast fibers as described herein (referred to herein as a "cohesion enhanced fabric").

During preparation of the control fabric, flax fibers were cleaned and bleached using a chemical degumming process. Next, the cleaned and bleached flax fibers were blended with 15 percent by weight 1.7 dtex Tencel®, based on the total fiber weight, to form a blended fiber composition. The blended fiber composition was then carded and hydroentangled to form the control fabric. The final composition of the control fabric included 85% flax fiber and 15% Tencel® by weight, based on the total weight of the fabric and the control fabric was produced having an overall basis weight of 85 grams per square meter ("gsm").

During preparation of the cohesion enhanced fabric, flax fibers were cleaned and bleached using a chemical degumming process in the same manner as provided during production of the control fabric. Next, a crimp was imparted on the cleaned and bleached flax fibers by contacting the fiber mat with a pair of crimping rolls, heated to a temperature of 150° C. and having a pressing force therebetween of 35 pounds per square inch ("psi"), corresponding to a crimping force of about 50 $lb_f$ per linear inch. The crimped fiber mat exhibited the following crimp parameters: an average of 7.6 crimps per centimeter; an average crimp angle of 90 degrees; and an average distance of 0.33 mm between crimps. Next, the crimped fiber mat was carded and hydroentangled to form the cohesion enhanced fabric in the same manner as provided during production of the control fabric. The final composition of the cohesion enhanced fabric included 100% crimped flax fibers by weight, based on the total weight of the fabric, and the cohesion enhanced fabric was produced having an overall basis weight of 85 gsm.

Following preparation of the two fabrics, the machine direction (MD) and cross direction (CD) tear strength of each fabric was measured. Tear strength testing was conducted using the trapezoid procedure in accordance with ASTM D5587-15(2019), Standard Test Method for Tearing Strength of Fabrics by Trapezoid Procedure, ASTM International, West Conshohocken, PA, 2019. Tear strength data was measured in units of Newtons of force (N) required to tear the fabric in half. Table 2 below illustrates the MD and CD tear strength values achieved during testing of both the control fabric and the cohesion enhanced fabric comprising crimped bast fibers. As illustrated in Table 2, the cohesion enhanced fabric demonstrated superior tear strength in both machine and cross directions (36.9 N and 27.1 N, respectively) when compared to the control fabric (20.8 N and 16.1 N, respectively).

TABLE 2

| | Control Fabric | Cohesion Enhanced Fabric |
|---|---|---|
| Machine Direction (Newtons) | 20.8 N | 36.9 N |
| Cross Direction (Newtons) | 16.1 | 27.1 |

What is claimed is:

1. A method of forming crimped bast fibers, comprising:
providing an input of bast fibers;
adjusting the moisture content of the bast fibers to be in the range of about 10% to about 40% by weight;
forming the bast fibers into a fiber mat; and
contacting the fiber mat with a pair of heated crimping rolls to provide crimped bast fibers having a crimp of about 1 to about 10 crimps per centimeter, the pair of heated crimping rolls comprising a first crimping roll being positioned proximate to the top side of the fiber mat and opposing a second crimping roll positioned proximate to the bottom side of the fiber mat.

2. The method of claim 1, further comprising compressing the fiber mat prior to contact with the heated crimping rolls.

3. The method of claim 1, wherein the pair of heated crimping rolls maintain a temperature of between about 100° C. to about 250° C.

4. The method of claim 1, wherein the pair of heated crimping rolls are configured to apply a force to the fiber mat of about 5 $lb_f$ per linear inch to about 100 $lb_f$ per linear inch.

5. The method of claim 1, wherein the contacting step comprises one or more pairs of heated crimping rolls.

6. The method of claim 1, wherein the crimps in the crimped bast fibers are substantially triangular in shape.

7. The method of claim 1, wherein the crimps have a crimp angle in the range of about 30° to about 150° as measured from a tip of the crimp.

8. The method of claim 1, further comprising drying the crimped bast fibers to a moisture content of about 5% to about 20% based on the total weight of the crimped bast fibers following the contacting step.

9. The method of claim 1, further comprising subjecting the bast fibers to a fiber opener configured to open the fibers and adjust the density of the input of bast fibers prior to adjusting the moisture content.

10. The method of claim 9, further comprising extracting excess air from the opened bast fibers using an air separator following the fiber opening step and prior to adjusting the moisture content.

11. The method of claim 1, further comprising forming a nonwoven fabric comprising at least about 5% by weight of the crimped bast fibers.

12. The method of claim 11, wherein forming the nonwoven fabric comprises a drylaid process, an airlaid process, or a wetlaid process.

13. The method of claim 1, wherein the adjusting step comprises subjecting the bast fibers to air drying to achieve the desired moisture content.

14. The method of claim 1, wherein the adjusting step comprises subjecting the bast fibers to steam conditioning to achieve the desired moisture content.

15. The method of claim 14, wherein the steam conditioning step comprises contacting the fiber mat with saturated steam at atmospheric pressure.

16. The method of claim 1, further comprising adjusting the density of the bast fibers to provide density-controlled fibers prior to adjusting the moisture content.

17. The method of claim 1, wherein the bast fibers are extracted from flax, hemp, jute, ramie, nettle, Spanish broom, kenaf plants, or any combination thereof.

18. The method of claim 1, wherein said crimped bast fibers are substantially free of pectin.

* * * * *